US007201621B2

(12) United States Patent
Jones

(10) Patent No.: US 7,201,621 B2
(45) Date of Patent: Apr. 10, 2007

(54) PORTABLE BOW THRUSTER FOR SMALL BOATS

(76) Inventor: William M. Jones, 33955 Old Kinsman Rd., Hunting Valley, OH (US) 44022-6629

( * ) Notice: Subject to any disclaimer, the term of this patent is extended or adjusted under 35 U.S.C. 154(b) by 99 days.

(21) Appl. No.: 10/867,085

(22) Filed: Jun. 14, 2004

(65) Prior Publication Data

US 2004/0266280 A1 Dec. 30, 2004

Related U.S. Application Data

(60) Provisional application No. 60/478,225, filed on Jun. 13, 2003.

(51) Int. Cl.

| | |
|---|---|
| ***B63H 11/12*** | (2006.01) |
| ***B63H 11/02*** | (2006.01) |
| ***B63H 11/107*** | (2006.01) |
| ***B63H 25/46*** | (2006.01) |

(52) U.S. Cl. ..... 440/44; 440/40; 114/151

(58) Field of Classification Search ..... 114/150, 114/151; 440/6, 37, 38, 44, 45; 60/221, 60/222, 227

See application file for complete search history.

(56) References Cited

U.S. PATENT DOCUMENTS

| | | | | |
|---|---|---|---|---|
| 1,237,674 | A * | 8/1917 | Moiseeff | 440/42 |
| 3,116,598 | A * | 1/1964 | Blake | 60/222 |
| 4,208,978 | A | 6/1980 | Eller | |
| 4,487,149 | A | 12/1984 | Morris | |
| 4,549,868 | A * | 10/1985 | Lolly | 440/42 |
| 4,732,104 | A | 3/1988 | Roestenberg | |
| 4,807,552 | A | 2/1989 | Fowler | |
| 6,009,822 | A | 1/2000 | Aron | |
| 6,024,038 | A | 2/2000 | Kiliz | |
| 6,361,387 | B1 | 3/2002 | Clarkson | |
| 6,363,874 | B1 | 4/2002 | Griffith, Sr. | |

FOREIGN PATENT DOCUMENTS

RU 2169101 C2 * 6/2001

* cited by examiner

*Primary Examiner*—Ajay Vasudeva
(74) *Attorney, Agent, or Firm*—Fay Sharpe LLP

(57) ABSTRACT

A portable bow thruster for use on the bow of a boat in a body of water having a water line. The bow thruster includes a blower assembly for producing an air flow to provide thrust, an exhaust air duct for expelling the air flow from the blower assembly, pivoting means for pivoting the bow thruster in the clockwise and counterclockwise directions, support means for supporting the blower assembly, and a mounting assembly for mounting the bow thruster to the bow of the boat.

22 Claims, 9 Drawing Sheets

FIG.1
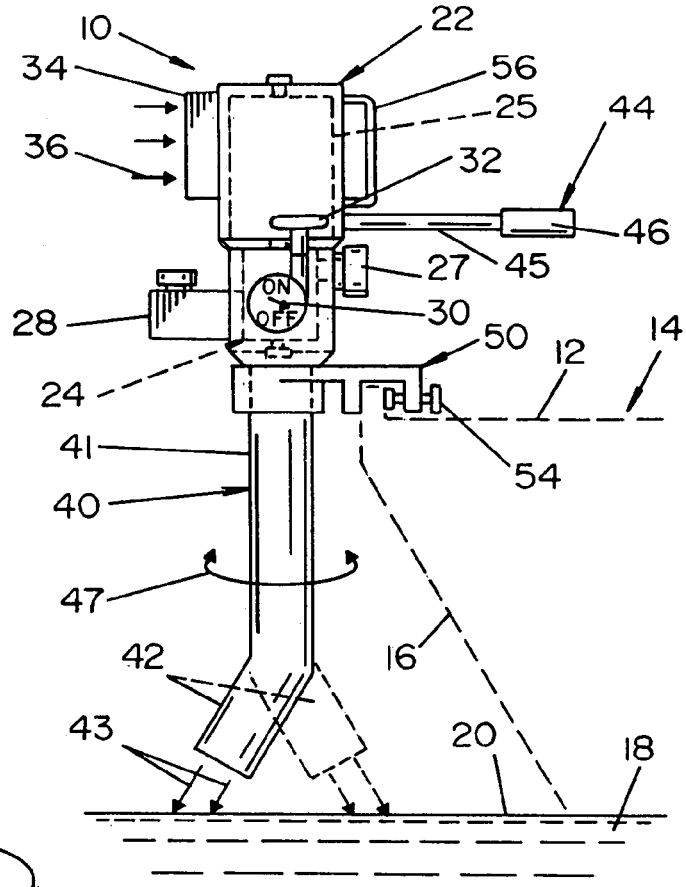
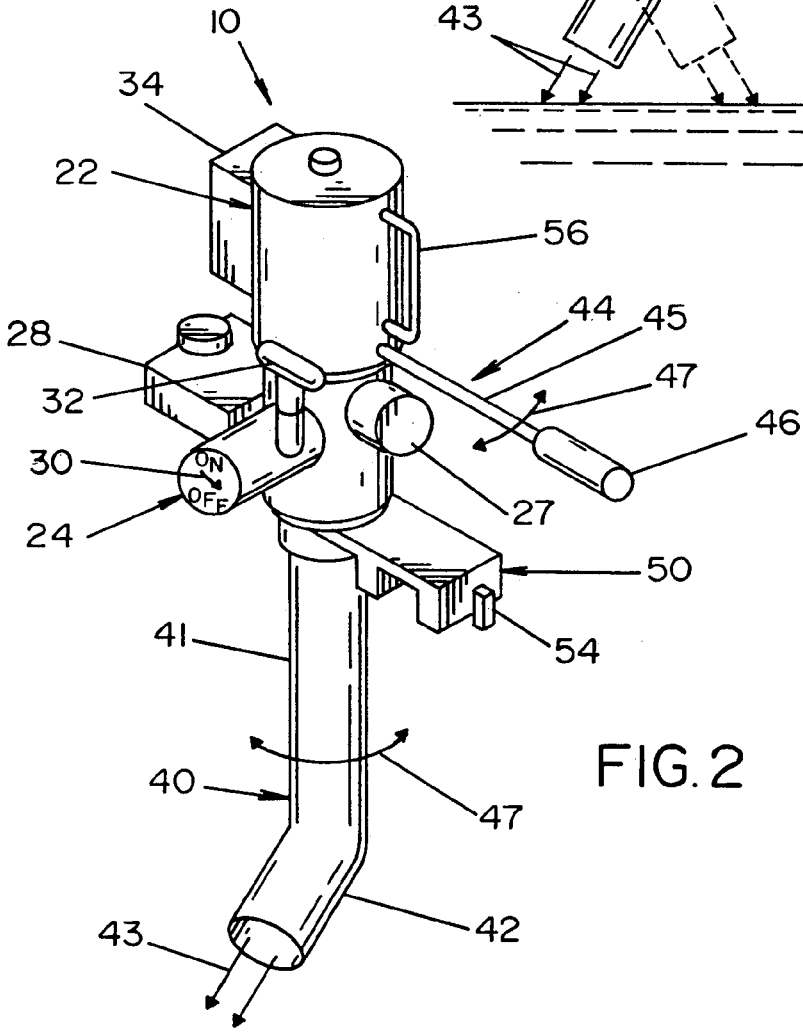
FIG.2

PORTABLE BOW THRUSTER FOR SMALL BOATS

This application claims the priority of provisional patent application Ser. No. 60/478,225, which was filed on Jun. 13, 2003.

FIELD OF THE INVENTION

The present invention relates generally to maneuvering systems for boats, and, more particularly, concerns a portable bow thruster for use with small boats.

BACKGROUND OF THE INVENTION

A bow thruster is a device that lets a boater more easily position a boat in difficult situations like docking and maneuvering in congested marinas. A bow thruster delivers a side-directional thrust force for maneuvering the boat. Bow thrusters generally operate on the principal of creating force to counteract the unwanted lateral swinging of the bow of the boat to stabilize the lateral position of the boat. The bow thruster must be sized to provide a thrust force that is sufficient under all sorts of weather and water conditions. Conventional bow thrusters typically involve positioning a motorized propeller beneath the water line adjacent the bow, where rotation of the propeller blade can be controlled to counteract the unwanted lateral movement of the bow. However, permanent modifications to the boat are normally necessary in order to attach these bow thrusters to existing boats that were built without this device in mind.

A variety of bow thruster and related devices are known in the art. For example, U.S. Pat. No. 4,208,978 discloses a bow thruster for a water vessel that may be attached to existing vessels and has a submersible pumping unit for producing lateral thrust. The submersible pumping unit consists of a rotary hydraulic motor driving an axial float pump, with both the motor and the pump being mounted in a flow-through housing that can be lowered into the water or raised out of the water by a hydraulic cylinder piston unit mounted on the exterior of the vessel's hull at the bow. A motor-driven pump on board the boat operates the hydraulic motor through flexible hoses. The submersible pumping unit has separate valves at the water intake and discharge sides of its pump for controlling the magnitude of the lateral thrust.

U.S. Pat. No. 4,732,104 discloses a pivotal bow thruster that may be transferred from boat to boat. The unit consists of a motor and two propellers, the unit being pivoted about the stem of the boat by being connected to a pivoting means. When the unit is in the lower active position, the propeller is actuated to rotate in one direction or another, thereby thrusting the bow of the boat in a particular lateral direction.

U.S. Pat. No. 4,807,552 discloses a small boat bow thruster that includes a port and a starboard discharge nozzle mounted through the hull of the boat above the water line. An inlet port is located at the boat hull below the water line, providing an inlet for water direction by a bi-directional water pump. The water pump is connected between the inlet part of the starboard side and port side outlet nozzles. Rotation of two rotors produces water flow from the inlet port through the starboard side outlet nozzle allowing the bow to be thrust to the port side, while rotation of the rotor is in the opposite direction produces the water flow from the inlet port through the port side nozzle allowing the bow to be thrust to the starboard side. The port and starboard nozzle exit from the boat hull above the water line and impinge on the surrounding water.

U.S. Pat. No. 6,024,038 discloses a side thruster for a small boat, which includes a valve, four water passageways, and a pump. One passageway extends between the first port and a side opening of the boat. The second passageway extends between the third port and another side opening. The third passageway extends between the second port and the pump outlet. The fourth passageway extends between the pump inlet and a pump fourth port. When the barriers move to a first position, the pump draws water from the second side opening and discharges the water through the first side opening. Conversely, when the barriers move to its second position, the pump draws water from the first side opening and discharges the water from through the second side opening. These side openings are located on the bow of the boat.

U.S. Pat. No. 6,363,874 discloses a rotational electric bow thruster for recreational water craft. This system includes a rotatable thrust assembly, which includes a prop or props coupled to and rotatable with the assembly. The prop is further coupled to a power transmission drive train, which is powered by a drive motor. The rotatable assembly is further coupled to an angular drive configured for orienting the prop to produce a thrust in a desired direction during operation.

U.S. Pat. No. 6,361,387 discloses a bow thruster comprising an impeller disposed in a tunnel at the bow of the vessel.

Although the above devices may provide side-directional thrust movement for water vessels, they are not without deficiencies (i.e., some are not portable, some require holes to be drilled in the hull, etc.) and further improvement is needed. More particularly, there is a need for a portable bow thruster that can be easily retrofitted to an existing boat without the need for any holes through the hull for flow, mounting, or electrical wires.

SUMMARY OF THE INVENTION

In accordance with the present invention, an improved bow thruster that is portable and may be easily mounted on the bow of a small boat in a body of water is provided.

One embodiment of the invention comprises a blower assembly for producing an air flow to provide thrust, an exhaust air duct for expelling the air flow from the blower assembly above or below the water line, pivoting means for pivoting the bow thruster in the clockwise and counterclockwise directions, support means for supporting the blower assembly, and a mounting assembly for mounting the bow thruster to the bow of the boat. The bow thruster may also include a carrying handle connected to the blower assembly for grasping the bow thruster. The exhaust air duct of the bow thruster may include telescoping means for allowing the air duct to be shortened or lengthened, whereby the telescoping means is secured in place by a lock collar. Preferably, the blower assembly comprises a motor, a squirrel cage blower wheel, a squirrel cage, an air intake, and a blower filter. The exhaust air duct may also includes an air diverter valve at the outlet end of the exhaust air duct, whereby the air diverter valve is controlled manually by an air diverter lever mounted on the exhaust air duct adjacent the blower assembly.

An alternative embodiment of the invention comprises a pump assembly, rotating means for rotating said bow thruster in the clockwise and counterclockwise directions, a water pipe assembly for receiving water and discharging water below said water line to provide thrust, and a mounting assembly. The rotating means may comprise a rotatable valve and a control assembly, where the control assembly includes a radio receiver mounted on the bow thruster. The control assembly typically includes a standard keypad on the bow thruster for operating the radio receiver from the deck and a portable radio transmitter for operating the radio receiver from ashore.

It is therefore the object of the present invention to provide an improved bow thruster for a small boat.

It is another object of the present invention to provide a bow thruster that can be easily retrofitted to an existing boat without the need for any holes through the hull for flow, mounting, or electrical wires.

It is still another object of the present invention to provide a bow thruster that is light and can be easily detached and stowed when not in use.

It is still another object of the present invention to provide an improved bow thruster that is less expensive to build and maintain than conventional bow thrusters by using common parts and materials.

It is still another object of the present invention to provide a bow thruster that can be controlled remotely by a person who is ashore.

Some of the objects of the invention having been stated, other objects will become evident as the description proceeds, when taken in connection with the accompanying drawings described below.

BRIEF DESCRIPTION OF THE DRAWINGS

The drawings are only for purposes of illustrating preferred embodiments and are not to be construed as limiting the invention. The invention may take form in various components and arrangements of components, and in various steps and arrangements of steps, the preferred embodiments of which will be illustrated in the accompanying drawings.

FIG. 1 is a schematic side view of a boat incorporating an air discharge bow thruster constructed in accordance with a preferred embodiment of the present invention.

FIG. 2 is an enlarged schematic perspective view of the bow thruster of FIG. 1.

DETAILED DESCRIPTION OF THE PREFERRED EMBODIMENTS

It is to be understood that the specific devices illustrated in the attached drawings and described in the following specification are simply exemplary embodiments of the inventive concepts defined in the appended claims. Therefore, specific examples and characteristics relating to the embodiments disclosed herein are not to be considered as limiting, unless the claims expressly state otherwise.

Figure 3:
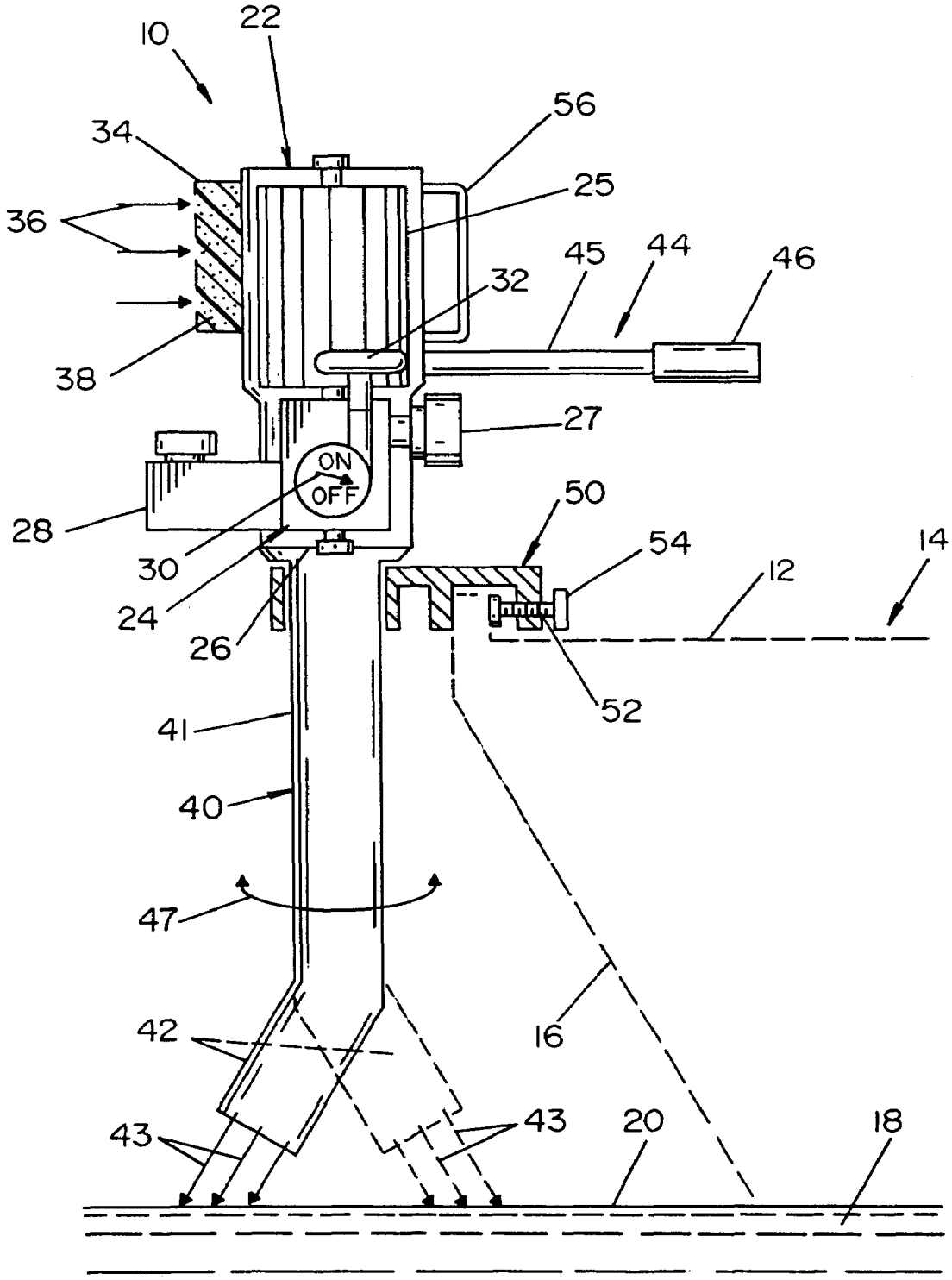
FIG. 3 is a further enlarged sectional side view of the bow thruster of FIG. 1.

Referring to the drawings, wherein like numerals indicate like elements throughout, there is shown in FIGS. 1–3 an improved bow thruster 10 mounted on the bow 12 of a small boat 14. As is well known in the art, the bow 12 is a sharp edge with the side of the boat 14 tapering out from it to reduce drag through the water. The bow 12 is angled so as to cut through rough seas easily. The hull 16 of the boat 14 is submerged in a body of water 18 having a water line 20.

Figure 3A:
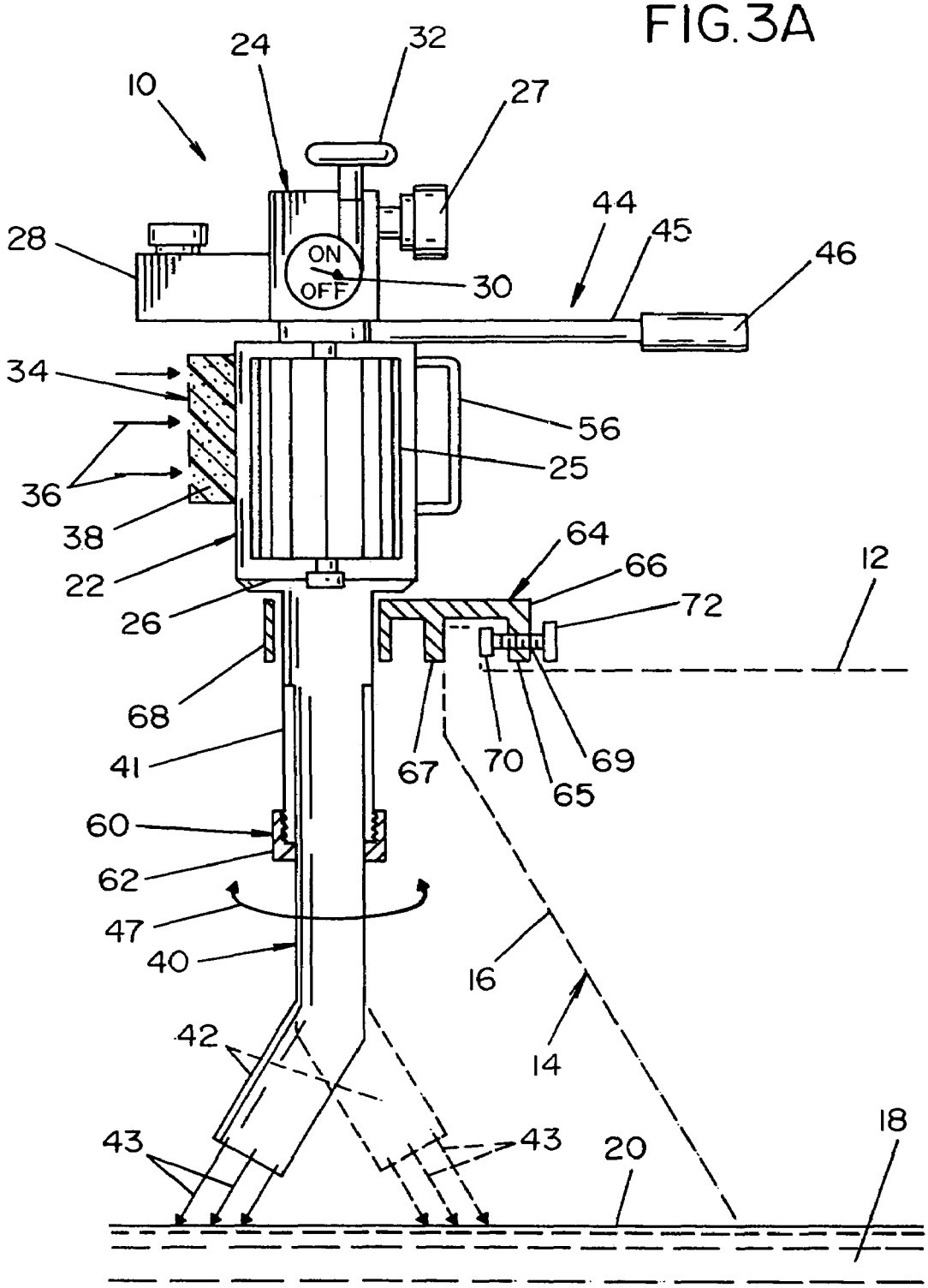
FIG. 3A illustrates a side view of an alternative embodiment of the bow thruster of FIG. 1 having telescoping means on the air discharge duct and showing the motor blower reversed.
Figure 3B:
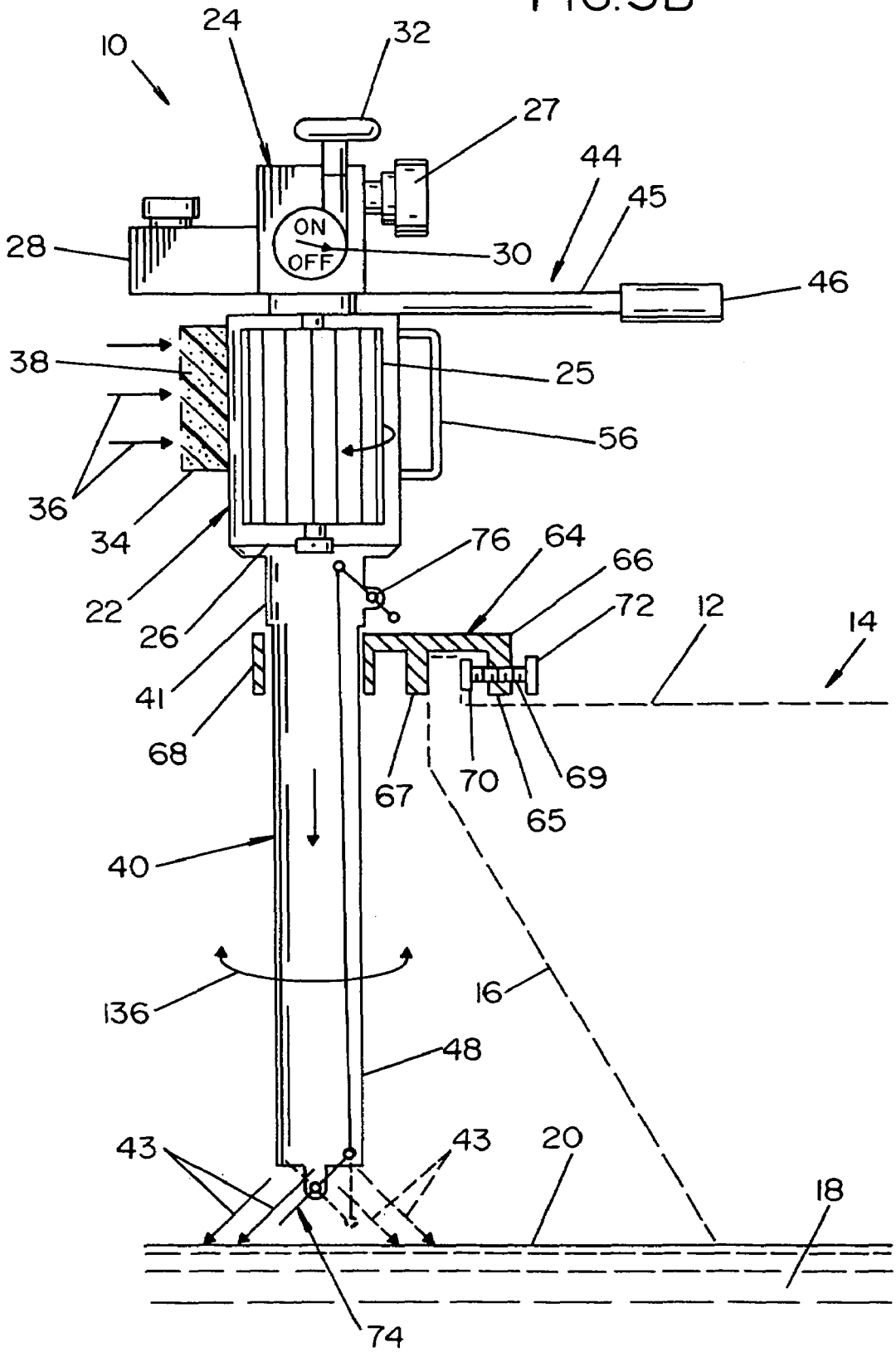
FIG. 3B illustrates a front view of an alternative embodiment similar to FIG 3A having an air diverter valve on the air discharge duct.

As shown in FIGS. 1–3, the bow thruster 10 includes a blower 22. The blower 22 is comprised of a motor 24, a squirrel cage blower wheel, and a cage 25 typically referred to as a squirrel cage. However, the blower 22 may also comprise a consumer cooling-type fan instead of a squirrel cage-type blower. Further, the motor 24 is preferably an internal combustion engine, such as a two-stroke engine or a four-stroke engine, but a high-speed DC electric drive motor may be employed instead for powering the blower 22. FIGS. 1–3 show the motor 24 mounted just below the blower 22, but it may also be mounted above the blower 22, as shown in FIG. 3A and FIG. 3B. The motor 24 may be supported by a spider support 26 or similar support device known in the art. A fuel tank 28 may be attached to and in fluid communication with the motor 24. The motor 24 may also include an air intake 27, as shown in FIG. 3A. A switch 30 on the motor 24 controls the ignition system (not viewable) of the motor 24. The switch 30 must be in the ON position for the motor 24 to start and run. Pulling a recoil starter 32 cranks the motor 24 for starting. Moving the switch 30 to the OFF position stops the motor 24. It should be understood that instead of a recoil starter 32, the motor 24 could have an electric starter, which would use a charge from a battery to start the motor 24.

The blower 22 includes an air intake 34, which is preferably annular but can be square or some other shape. The air intake 34 provides air flow, represented by arrows 36, into the blower 22. A blower intake filter 38 is also provided to prevent a user from accidentally allowing their hand or other objects to enter the air intake 34 and into the blower 22. Preferably, the air intake 34 is made from steel and is attached with screws or other removable fasteners to the blower 22. However, it will be recognized by those skilled in the art that the air intake 34 could be made from other materials, such as fiberglass or other composite materials, if desired.

The blower 22 also includes an exhaust air duct 40 having a blower connection end 41 and an outlet end 42. The air duct 40 is an elongated tubular structure that is generally straight at the blower connection end 41 and has an arc or bow near the outlet end 42. The entire bow thruster 10, including the outlet end 42, is intended to be positioned above the water line 20. In operation, a flow of air from the blower 22, represented by arrows 43, is discharged through the outlet end 42 of the air duct 40 and impinges upon the surface of the water 18, thus producing the necessary side-directional thrust force for maneuvering the boat 14. The blower 22 is sized to provide a thrust force that is suitable for the boat 14 upon which it will be mounted and used. Further, in this configuration, the bow thruster 10 is not subject to damage from hitting objects in the water at high speeds nor does it create any hydrodynamic drag.

The bow thruster 10 further includes a pivoting means 44, which is attached with screws or other removable fasteners to the blower 22. The pivoting means 44 preferably comprises an elongated shaft 45 and a hand grip 46. Through the use of the pivoting means 44, the bow thruster 10 may be manually turned by the user in either the clockwise or counterclockwise direction, represented by arrows 47, so that the flow of air 43 may be expelled from the outlet end 42 of the air duct 40 to either the port or the starboard side of the boat 14.

The bow thruster 10 may be mounted to the bow 12 of the boat 14 in the following manner. As shown in FIGS. 2 and 3, a C-clamp 50 is attached to the bow thruster 10. The C-clamp 50 is adapted to interface with the bow 12 of the boat 14 to form a clamping device that attaches the bow thruster 10 to any type of boat. A bolt assembly 52 passes through the C-clamp 50 causing the C-clamp 50 to apply pressure as a clamping device. A wing-nut 54 or other locking mechanism is secured to the bolt assembly 52 in order to keep the C-clamp 50 securely fastened to the boat 14. The bow thruster 10 may also include a carrying handle 56 connected to the blower 20 for grasping in order to lift the bow thruster 10 while carrying it.

Those parts of the bow thruster 10 that are exposed to the water are made from corrosion resistant material, such as stainless steel, plastic, and/or fiberglass. The bow thruster 10 may be treated with a corrosion resistant coating, such as paint.

FIG. 3A illustrates an alternative embodiment wherein the exhaust air duct 40 includes a telescoping means 60. The telescoping means 60 allows for the air duct 40 to be manually shortened or lengthened as needed, depending upon the hull 16 height. Once the proper adjustments to the length of the air duct 40 have been made via the telescoping means 60, the air duct 40 may be easily secured in place by means of a lock collar 62 or other similar locking mechanism known to those skilled in the art.

The bow thruster 10 shown in FIG. 3 and described above is generally intended to be positioned entirely above the water line. However, it is to be appreciated that bow thruster 10 may be modified such that the outlet end 42 of the air duct 40 can be lowered below the water line 20 via the telescoping means 60, thus producing the necessary side directional thrust force for maneuvering the boat 14 below the water line.

FIGS. 3A and 3B illustrate alternative embodiments in which the motor 24 is mounted on top of the blower 22, rather than underneath it. In such a configuration, the bow thruster 10 may be mounted to the bow 12 by means of a mounting assembly 64. The mounting assembly 64 comprises a C-clamp portion 66 and a blower-retaining sleeve portion 68. The diameter of the sleeve 68 is such that the blower 22 may be firmly retained thereon, yet the exhaust air duct 40 may rotate within the sleeve 68. The C-clamp portion 66 is adapted to interface with the bow 12 of the boat 14 to form a clamping device that attaches the bow thruster 10 to any type of boat. The C-clamp portion 66 includes a securing jaw 67 and a free jaw 65. A fastening screw 69 is threaded into a recess extending through the free jaw 65 of the C-clamp portion 66. The fastening screw 69 acts to engage a portion of the bow 12 positioned between the securing jaw 67 and free jaw 65, thus securing the bow thruster 10 to the bow 12 of the boat 14. A rubber pad 70 or similar material may be positioned on the free jaw 65 and the fastening screw 69 to engage the bow 12. The rubber pad 70 provides a frictional engagement with the bow 12 while also acting to cushion and protect the surface of the bow 12 from the pressure applied by the fastening screw 69. The fastening screw 69 is tightened by a wing-nut 72 or similar locking mechanism.

FIG. 3B illustrates an alternative embodiment wherein the bow thruster 10 includes an air diverter valve 74 at the outlet end 48 of the exhaust air duct 40 instead of the pivoting means 44. In this embodiment, the exhaust air duct 40 is generally straight instead of having an arc or bow near the outlet end 42. In operation, the air flow 43 is discharged from outlet end 42 by the blower 22 and directed by the air diverter valve 74. The air diverter valve 74 is controlled manually by an air diverter lever 76. Thus, the air diverter lever 76 can be raised or lowered in order to direct the air flow 43 to the port or starboard side of the boat 14 as needed.

Figure 4:
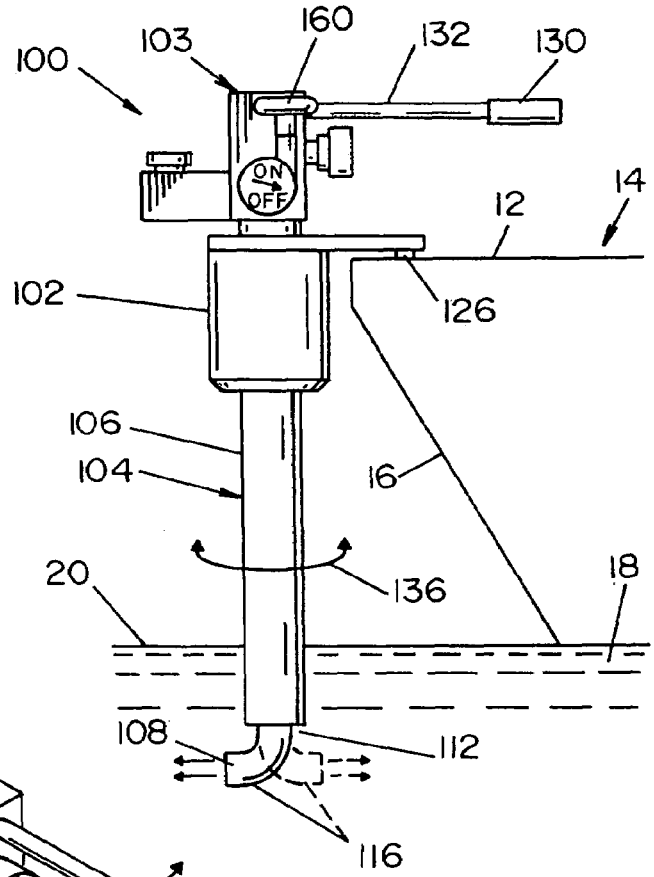
FIG. 4 is a schematic side view of a boat incorporating a submerged water jet bow thruster constructed in accordance with an alternative embodiment of the present invention.
Figure 5:
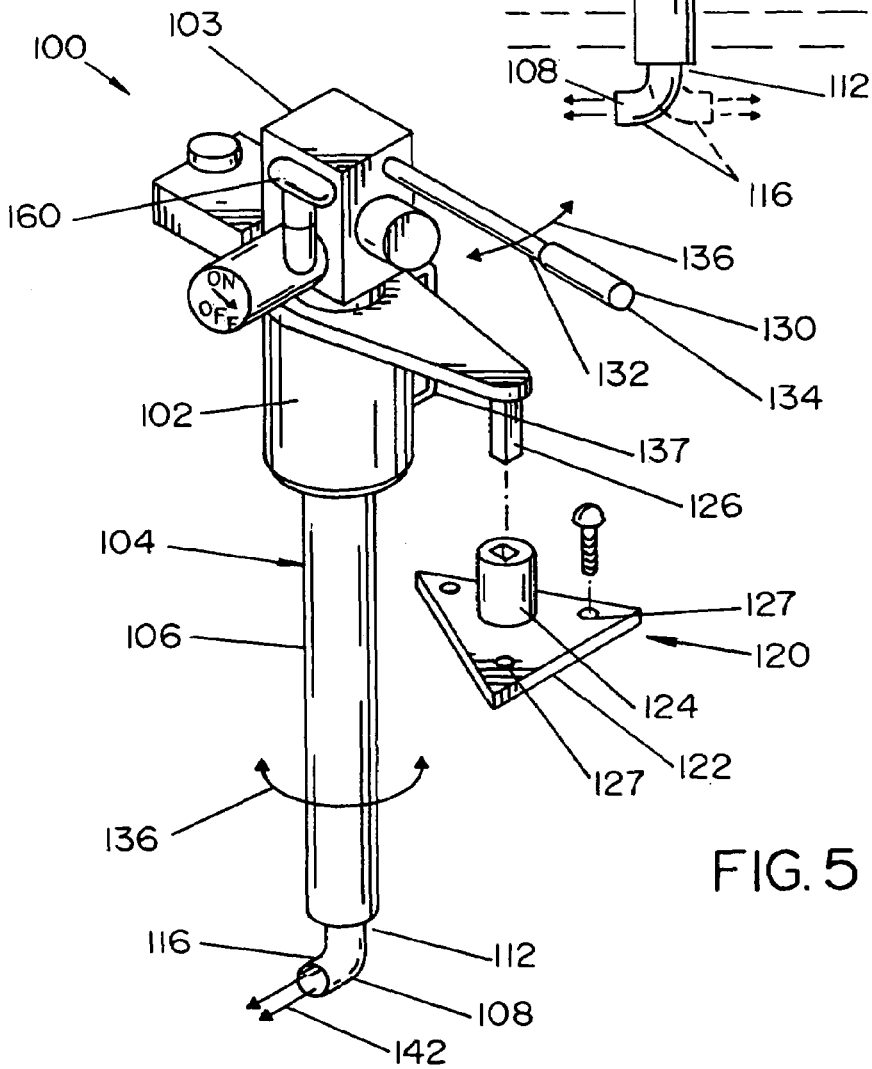
FIG. 5 is an enlarged schematic perspective view of the bow thruster of FIG. 4.

FIGS. 4–9 illustrate an alternative bow thruster 100 whereby a discharge of water below the water line 20 is used to maneuver the boat 14 laterally instead of a discharge of air above the water line 20. As shown in FIGS. 4 and 5, the bow thruster 100 includes a water pump 102 powered by a motor 103. The motor 103 may be a variable speed motor or a single-speed motor that can be pulsed on and off. The motor 103 is shown mounted above the water pump 102, although it may be understood that the motor 103 may be mounted differently. In this embodiment, instead of an exhaust air duct there is a water pipe assembly 104. The water pipe assembly 104 comprises an elongated water intake pipe 106 and a water discharge pipe 108 concentric with and positioned inside the water intake pipe 106. The diameters of the pipes 106 and 108 are sized such that there is sufficient room for the appropriate amount of water to be drawn up through the water intake pipe 106. The water intake pipe 106 has a pump connection end 110 and an inlet end 112. The water discharge pipe 108 has a pump connection end 114 and an outlet end 116 that extends past the inlet end 112 of the water intake pipe 106. The water intake pipe 106 is generally straight. On the other hand, the water discharge pipe may have an arc or bow at the outlet end 116.

As shown in FIG. 5, the bow thruster 100 may also be mounted to the bow 12 of the boat 14 by means of a mounting assembly 120. The mounting assembly 120 comprises a plate 122 for securing the assembly 120 to the bow 12 of the boat 14. The plate 122 includes a receiving portion 124. The bow thruster 100 may include a connecting portion 126 that is adapted to fit into the receiving portion 124 to secure the bow thruster 100 to the boat 14. Thus, to install the bow thruster 100, it would be possible to mount the bow thruster 100 to the bow 12 with only three small holes 127 to be drilled through the top of the bow 12. The bow thruster 100 may thus be readily installed on site without the need for any specialized equipment, and without having to make any holes in the hull of the boat 14. Once installed, the bow thruster 100 may remain permanently in place and is simple to operate. It may be understood that the bow thruster 100 may be mounted to the bow 12 in other ways, such as by being adapted to conform to the V-shape of the bow 12 and being held in place by belts or cables firmly lashed to fastening posts on each side of the deck (not shown).

The bow thruster 100 further includes a pivoting means 130, which is attached with screws or other removable fasteners to the motor 103. The pivoting means 130 preferably comprises an elongated shaft 132 and a hand grip 134. Through the use of the pivoting means 130, the bow thruster 100 may be manually turned by the user in either the clockwise or counterclockwise direction, represented by arrows 136, so that the flow of water may be expelled from the outlet end 116 of the water discharge pipe 108 to either the port or the starboard side of the boat 14. The bow thruster 100 may also have a carrying handle 137 connected to the motor 103 (or some other part of the bow thruster 100) to make it easier to carry to and from the boat 14.

Figure 6:
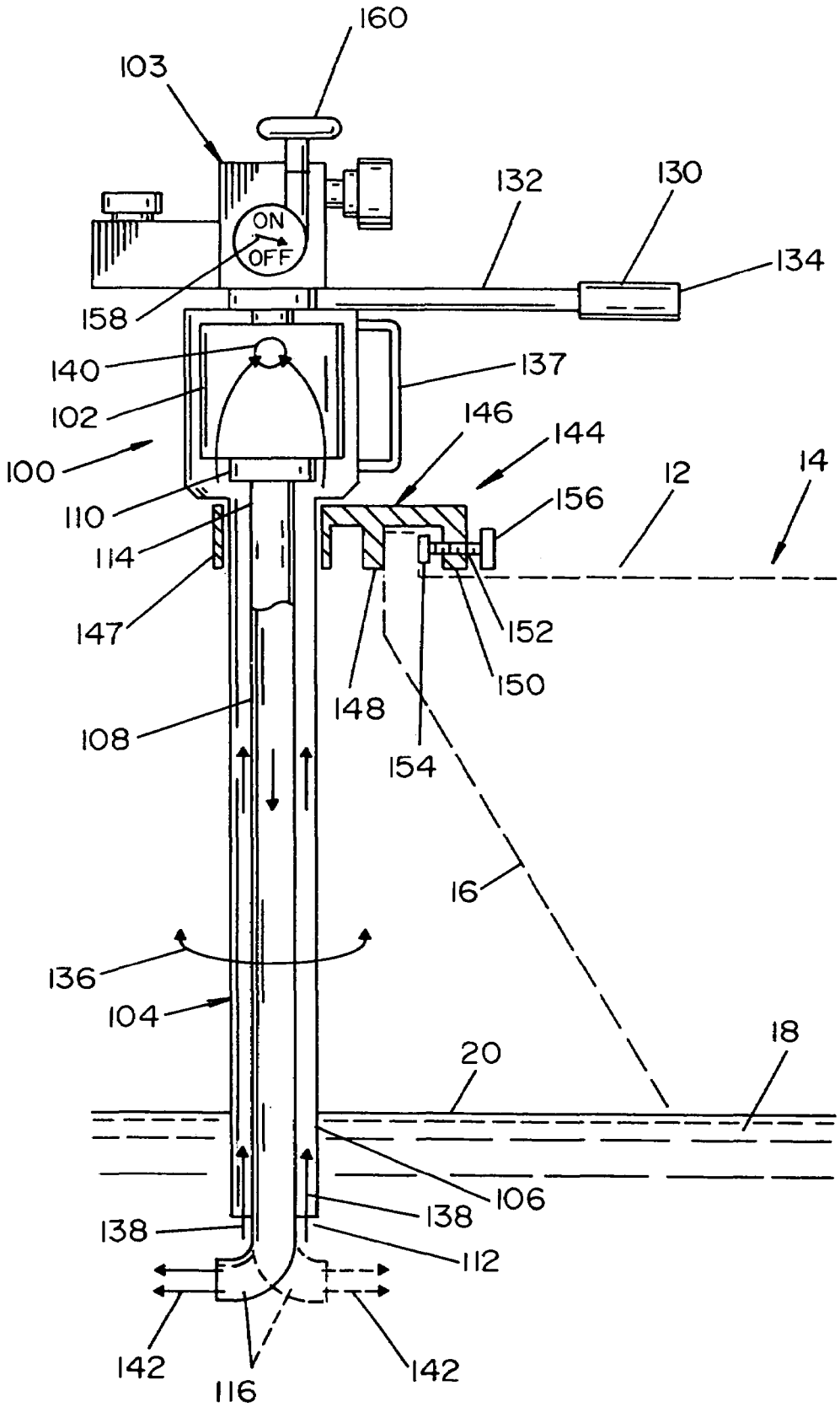
FIG. 6 is a further enlarged sectional side sectional view of the bow thruster of FIG. 4.
Figure 7:
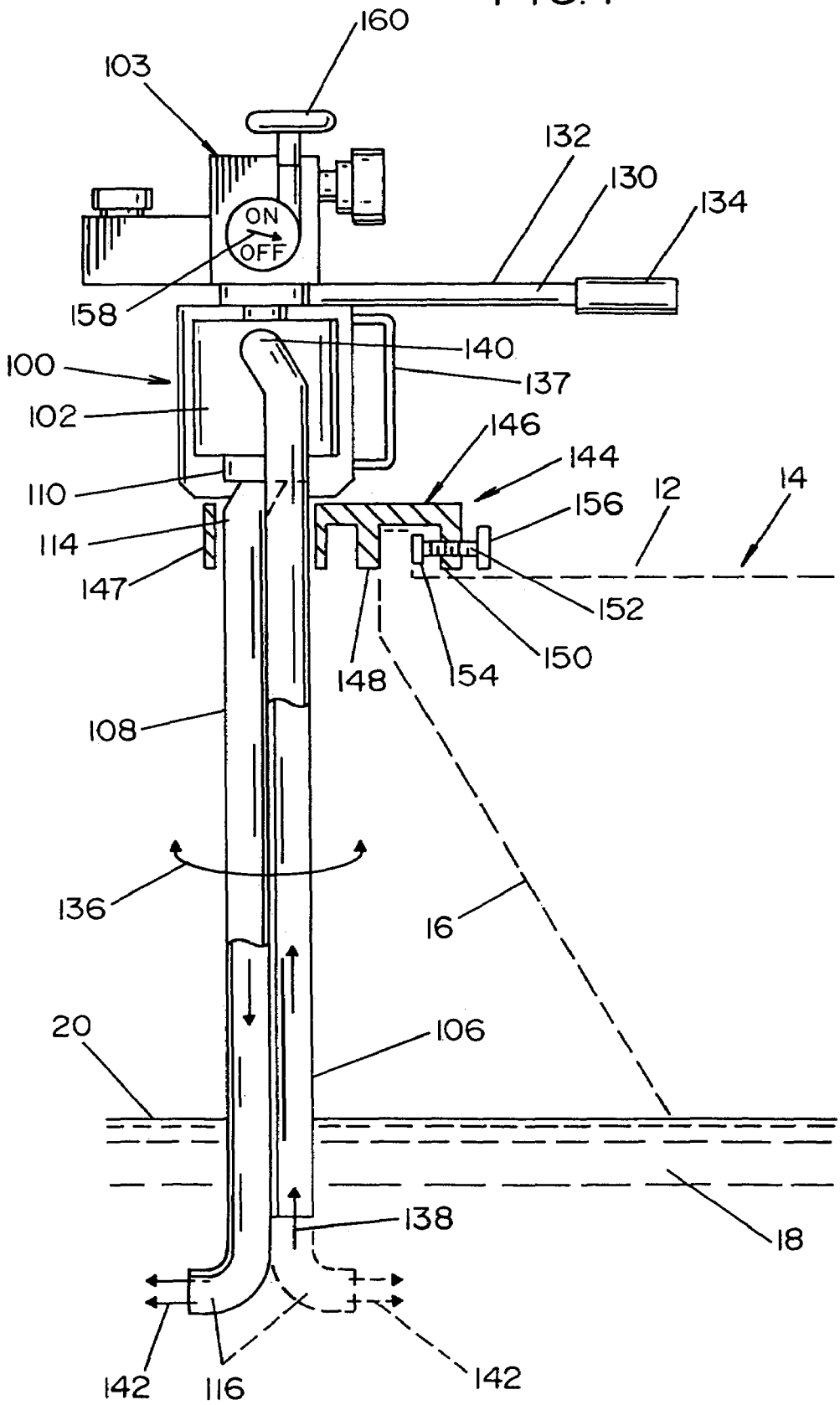
FIG. 7 is a view similar to FIG. 6 showing a modified water intake and exhaust.

Referring now to FIGS. 6 and 7, when the bow thruster 100 is mounted on the bow 12 of the boat 14, the water inlet end 112 and the outlet end 116 are submerged in the water 18 below the water line 20. Thus, in operation, the pump 102 causes water to be drawn up through the water intake pipe 106, represented by arrows 138, into a pump intake 140 located within the pump 102, and back down through the water discharge pipe 108. The user of the bow thruster 100 is thus able to direct a flow of water, represented by arrows 142, below the water line 20 to either the starboard side or to the port side of the boat 14 by use of the pivoting means 130 and with a thrust force sufficient to maneuver the boat 14 in all sorts of weather and water conditions.

The bow thruster 100 may be mounted to the bow 12 by means of a mounting assembly 144. The mounting assembly 144 comprises a C-clamp portion 146 and a pump-retaining sleeve portion 147. The diameter of the sleeve 147 is such that the pump 102 may be firmly retained thereon, yet the water pipe assembly 104 may rotate within the sleeve 147. The C-clamp portion 146 is adapted to interface with the bow 12 of the boat 14 to form a clamping device that attaches the bow thruster 100 to any type of boat. The C-clamp portion 146 includes a securing jaw 148 and a free jaw 150. A fastening screw 152 is threaded into a recess extending through the free jaw 150 of the C-clamp portion 146, thus engaging a portion of the bow 12 positioned between the securing jaw 148 and the free jaw 150 and securing the bow thruster 100 to the bow 12 of the boat 14. A rubber pad 154 or similar material may be positioned on the free jaw 150 and/or the fastening screw 152 to engage the bow 12. The fastening screw 152 is tightened by a wing-nut 156 or similar locking mechanism.

Although not shown, the bow thruster 100 may alternatively be held in place on the bow 12 of the boat 14 by either belts or cables firmly lashed to a set of fastening posts on the deck of the boat 14, as known to those skilled in the art.

A switch 158 on the motor 103 controls the ignition system (not viewable) of the motor 103. The switch 158 must be in the ON position for the motor 103 to start and run. Pulling a recoil starter 160 cranks the motor 103 for starting. Moving the switch 158 to the OFF position stops the motor 103. It is to be appreciated that the motor 103 could have an electric starter (not shown) that would use a charge from a battery to start the motor 103.

As shown in FIG. 7 the rump 102 may have the water intake 106 and the water exhaust 108 siamesed as an alternate embodiment.

Figure 8:
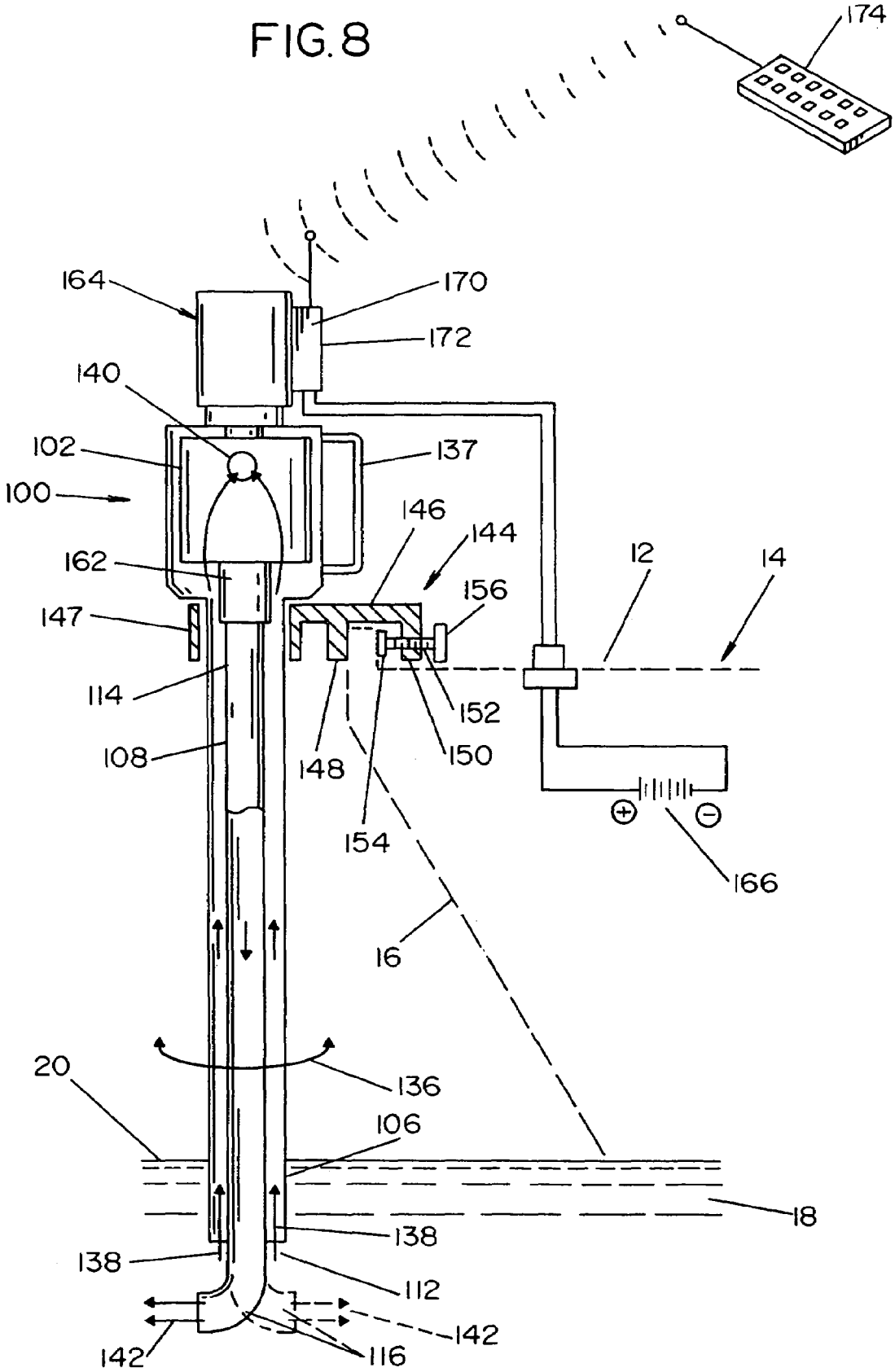
FIG. 8 is a schematic side sectional view of an alternative embodiment of the bow thruster of FIG. 4, showing a receiver for controlling the bow thruster.
Figure 9:
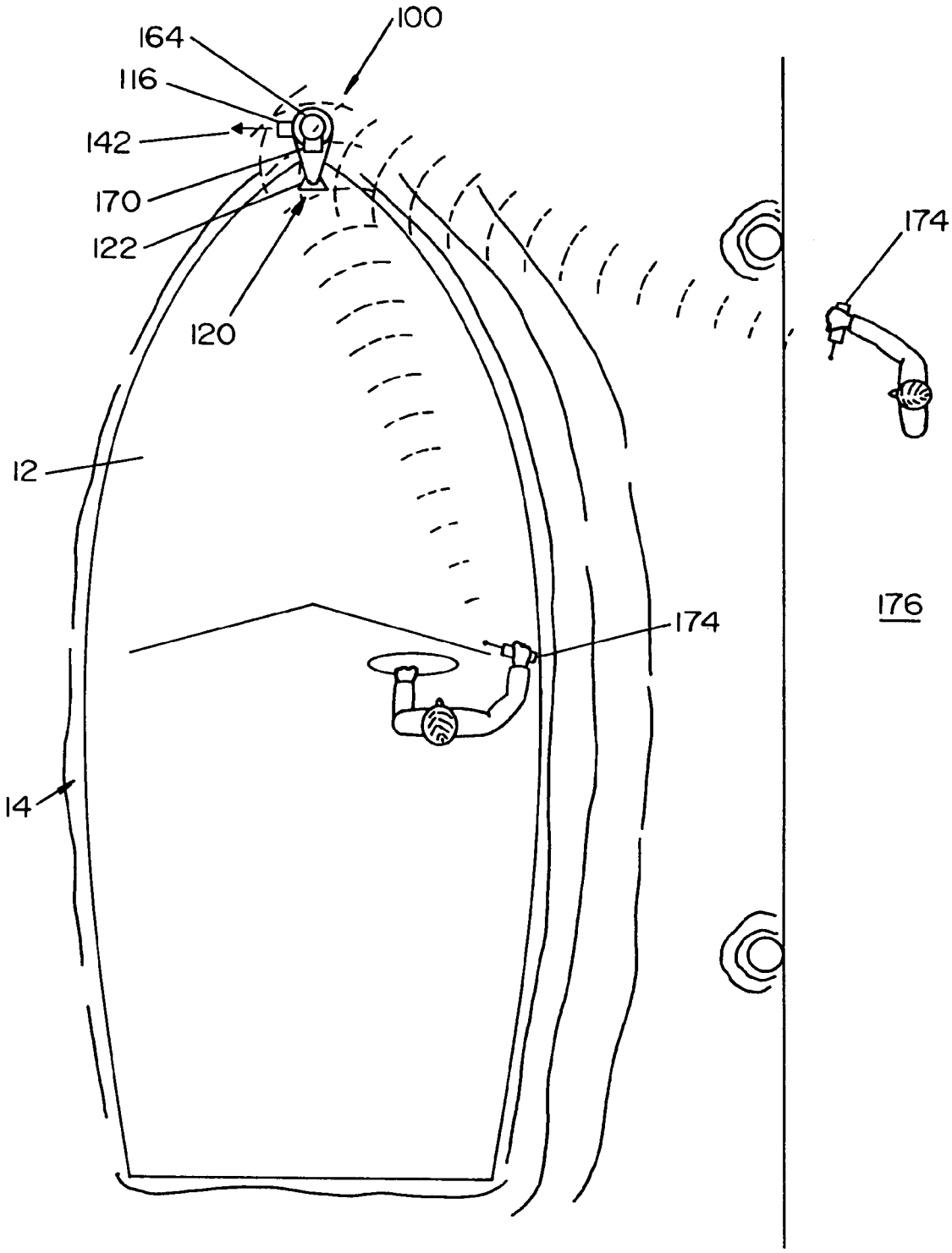
FIG. 9 is a schematic top plan view of an alternative embodiment of the bow thruster of FIG. 4, showing the bow thruster being remotely controlled.

FIGS. 8 and 9 illustrate an alternative embodiment wherein the bow thruster 100 may be controlled remotely, as well as manually. In this embodiment, a rotatable valve 162, which can be manual or electric, is located below the pump 102. The rotatable valve 162 allows the bow thruster 100 to rotate in either the clockwise or the counterclockwise direction. An electric motor 164 is rotatably connected to the valve 162 and drives the pump 102. The electric motor 164 is electrically connected to and powered by a battery 166 that is conveniently located on the deck of the boat 14. The electric motor 164 is operated by a radio receiver 170. The radio receiver 170 can be operated manually via a standard keypad 172 on the receiver 170 or remotely via a separate radio transmitter 174 that may be held by the operator on the boat 14 or on the dock 176.

Thus, an advantage of the improved bow thruster constructed in accordance with the alternative embodiment of the invention is that it can be attached above the water line with only tiny holes through the hull for mounting and electric wiring. Further, it can be temporarily installed and easily removed.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalence thereof.

What is claimed is:

1. A portable bow thruster of a boat for use on the bow of a boat in a body of water having a water line, comprising:

a blower assembly for producing an air flow capable of providing propulsive thrust to said boat;

an exhaust air duct for expelling said air flow from said blower assembly, said exhaust air duct including telescoping means for allowing said air duct to be shortened or lengthened;

pivoting means attached to said blower assembly for pivoting said bow thruster in the clockwise and counterclockwise directions;

support means for supporting said blower assembly; and a mounting assembly for detachably mounting said bow thruster to said bow of said boat.

2. The bow thruster defined in claim 1, wherein said mounting assembly allows said bow thruster to be mounted on the bow of the boat above said water line and expel said air flow from said blower assembly above said water line.

3. The bow thruster defined in claim 1, wherein said air flow is expelled from said blower assembly below said water line.

4. The bow thruster defined in claim 1, wherein said blower assembly comprises a consumer cooling-type fan.

5. The bow thruster defined in claim 1, wherein said support means comprises a support spider.

6. The bow thruster defined in claim 1, wherein said pivoting means comprises an elongated shaft and a hand grip.

7. The bow thruster defined in claim 1, wherein said bow thruster includes a carrying handle connected to said blower assembly for grasping said bow thruster.

8. The bow thruster defined in claim 1, wherein said telescoping means is secured in place by a lock collar.

9. The bow thruster defined in claim 1, wherein said blower assembly comprises a motor, a squirrel cage blower wheel, a squirrel cage, an air intake, and a blower filter.

10. The bow thruster defined in claim 9, wherein said motor comprises a DC electric drive motor.

11. The bow thruster defined in claim 9, wherein said motor comprises an internal combustion engine.

12. The bow thruster defined in claim 11, wherein said internal combustion engine comprises a two stroke engine.

13. The bow thruster defined in claim 11, wherein said internal combustion engine comprises a four stroke engine.

14. The bow thruster defined in claim 9, wherein said motor is located below said blower.

15. The bow thruster defined in claim 9, wherein said motor is located above said blower.

16. The bow thruster defined in claim 15, wherein said mounting assembly comprises a C-clamp portion and a blower retaining sleeve portion.

17. The bow thruster defined in claim 1, wherein said mounting assembly comprises a C-clamp, a bolt assembly, and a wing nut secured to said bolt assembly In order to keep said C-clamp securely fastened onto said bow of said boat.

18. The bow thruster defined in claim 1, wherein said exhaust air duct has a blower connection end and an outlet end.

19. The bow thruster defined in claim 18, wherein said exhaust air duct comprises an elongated tubular structure that is generally straight at said blower connection end and has an arc near said outlet end.

20. The bow thruster defined in claim 19, wherein said air flow is discharged through said outlet end of said air duct and impinges upon the surface of said water, said outlet end being located above said water line of said water.

21. The bow thruster defined in claim 1, wherein said exhaust air duct includes an air diverter valve at said outlet end.

22. The bow thruster defined in claim 21, wherein said air diverter valve is controlled manually by an air diverter lever mounted on said exhaust air duct at said exhaust air duct at said blower connection end.

* * * * *